US006048283A

United States Patent [19]

Albarelli, Jr.

[11] Patent Number: 6,048,283

[45] **Date of Patent: *Apr. 11, 2000**

[54] TOY GAME IMPLEMENTS

[75] Inventor: Michael P. Albarelli, Jr., Chester Township, N.J.

[73] Assignee: Amloid Corporation, Saddle Brook, N.J.

[ * ] Notice: This patent is subject to a terminal disclaimer.

[21] Appl. No.: 09/096,037

[22] Filed: Jun. 11, 1998

Related U.S. Application Data

[63] Continuation-in-part of application No. 08/881,295, Jun. 24, 1997, Pat. No. 5,766,104.

[51] Int. Cl.[7] ..... A63B 59/06; A63B 39/00; A63D 9/00

[52] U.S. Cl. ..... 473/567; 473/612; 473/119

[58] Field of Search ..... 473/118, 119, 473/121, 564, 566–568, 612, 613

[56] References Cited

U.S. PATENT DOCUMENTS

| | | | |
|---|---|---|---|
| 2,772,091 | 11/1956 | Harris | 473/119 |
| 4,006,908 | 2/1977 | Minami . | |
| 4,053,156 | 10/1977 | Bai . | |
| 4,079,935 | 3/1978 | Gormley . | |
| 4,374,590 | 2/1983 | Everlith et al. . | |
| 4,541,629 | 9/1985 | Witkowski . | |
| 4,581,299 | 4/1986 | Jager | 473/612 |
| 4,874,570 | 10/1989 | Haines . | |
| 4,957,300 | 9/1990 | Storry | 473/613 |
| 5,150,897 | 9/1992 | Wortman . | |
| 5,301,940 | 4/1994 | Seki et al. . | |
| 5,306,001 | 4/1994 | Shishido et al. . | |
| 5,480,143 | 1/1996 | McMurry . | |
| 5,676,611 | 10/1997 | Foster et al. | 473/613 |
| 5,766,104 | 6/1998 | Albarelli, Jr. | 473/567 |

*Primary Examiner*—Mark S. Graham
*Attorney, Agent, or Firm*—Arthur Jacob

[57] ABSTRACT

A toy game implement in the form of a baseball bat, a football or a bowling pin, each especially well-suited to manufacture by injection molding. The toy game implement includes a body having longitudinally spaced apart semi-annular ribs supported and reinforced by a central web in the form of a solid blade-like wall and external stringers spaced laterally from the web.

16 Claims, 7 Drawing Sheets

138
10
56
120
122
130
62
50
60
74
74
C
64
80
82
L
D
100
100
70
102
102
54
10

56
11
120
122
132
130
62
90
50
60
92
100
80
82
12
12
70
D
140
140
142
142
54
11

TOY GAME IMPLEMENTS

This is a continuation-in-part of application Ser. No. 08/881,295, filed Jun. 24, 1997, U.S. Pat. No. 5,766,104.

The present invention relates generally to toys and games and pertains, more specifically, to the construction of toy game implements, such as bats, clubs, sticks, balls, bowling pins and the like, which are used by a child in playing games.

Toy game implements have been a mainstay in the realm of toys and games and, over the years, have been offered in many different forms and structures. For example, toy baseball bats have been manufactured of metal, wood and synthetic polymeric materials in a myriad of shapes and sizes. Among the more popular toy game implements are those manufactured by blow molding a synthetic polymeric material to form a hollow game implement in the shape of a baseball bat, a ball or a bowling pin. However, blow molding is a more expensive molding technique as compared to other available molding methods, such as injection molding, and is limited to the use of only certain materials, such as blow-moldable polyethylene, while more desirable materials, such as high-density polyethylene, used in injection molding processes, are not amenable to blow molded manufacture.

The present invention enables toy game implements, such as those previously made by blow molding, to be manufactured by injection molding to yield toy game implements constructed of materials heretofore not practical for such implements. As such, the present invention attains several objects and advantages, some of which are summarized as follows: Enables the manufacture of toy game implements, such as toy baseball bats, balls and bowling pins, using injection molding techniques and materials heretofore not available for such toys; provides toy game implements, such as bats, clubs, sticks, balls, bowling pins and the like, of increased strength and reliability; produces toy game implements which exhibit an effective combination of unique and highly distinctive form as well as an aesthetically attractive appearance; attains a desired resilience coupled with reinforced strength in toy game implements of economical construction; allows economical manufacture of toy game implements of better controlled dimensions in larger quantities of consistently higher quality and in a wider variety of desirable shapes, sizes and colors; enables the manufacture of rugged toy game implements providing exemplary performance over a relatively long service life.

The above objects and advantages, as well as further objects and advantages, are attained by the present invention which may be described briefly as a toy game implement particularly well-suited for manufacture by injection molding of a synthetic polymeric material, the implement comprising: an elongate body extending longitudinally between opposite first and second ends and having a longitudinal length; an outer contour configuration including longitudinal profile components and lateral profile components; a web extending longitudinally between the first end and the second end, the web including laterally opposite edges and opposite faces extending between the laterally opposite edges, each edge following a web-edge profile corresponding to a longitudinal profile component of the outer contour configuration of the body; a plurality of ribs spaced from one another longitudinally along the body to establish spaces between adjacent ribs, the ribs intersecting the web along the edges of the web, each rib being placed at an individual longitudinal location along the web and following a rib profile corresponding to a lateral profile component of the outer contour configuration of the body, the ribs and spaces being grouped in laterally opposite first and second sets of ribs and spaces, the first set of ribs and spaces being staggered longitudinally with respect to the second set of ribs and spaces such that the ribs of the first set are located laterally opposite the spaces of the second set and the ribs of the second set are located laterally opposite the spaces of the first set; and stringers spaced laterally from the opposite faces of the web and joining the ribs of the first set to the ribs of the second set, the stringers extending along stringer profiles corresponding to further longitudinal profile components of the outer contour configuration of the body.

The invention will be understood more fully, while still further objects and advantages will become apparent, in the following detailed description of preferred embodiments of the invention illustrated in the accompanying drawing, in which.

Figure 1:
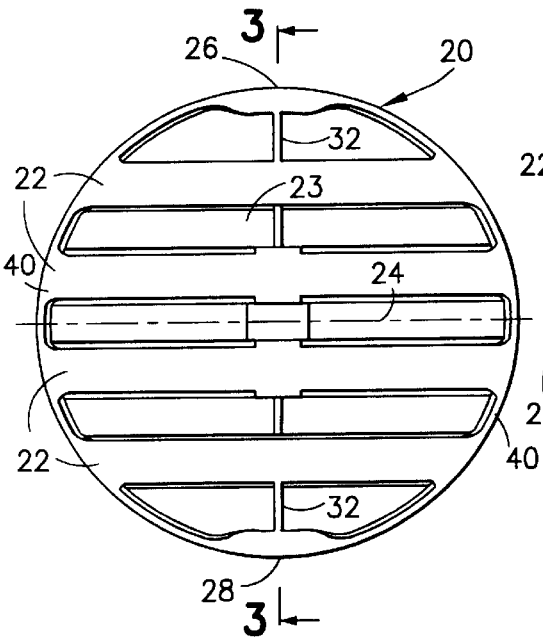
FIG. 1 PRIOR ART
FIG. 1 is an enlarged front elevational view of a toy ball known in the prior art.
Figure 2:
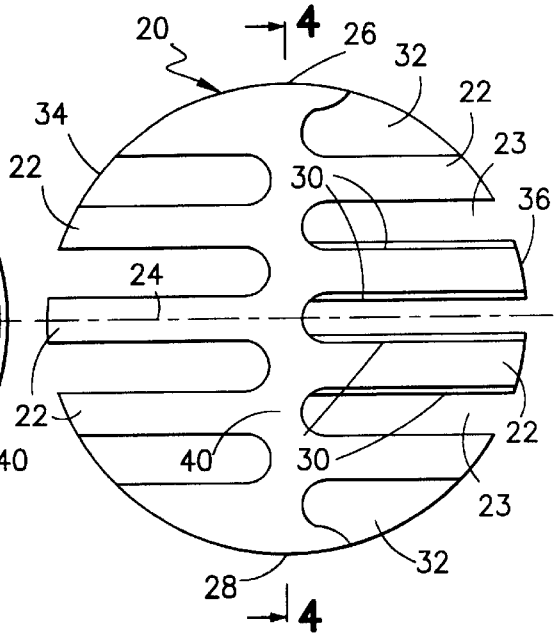
FIG. 2 PRIOR ART
FIG. 2 is a side elevational view of the toy ball.
Figure 3:
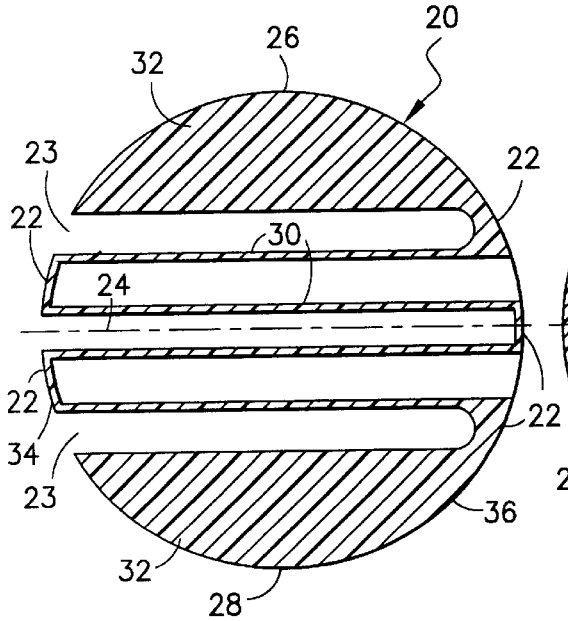
FIG. 3 PRIOR ART
FIG. 3 is a cross-sectional view of the toy ball, taken along line 3—3 of FIG. 1.
Figure 4:
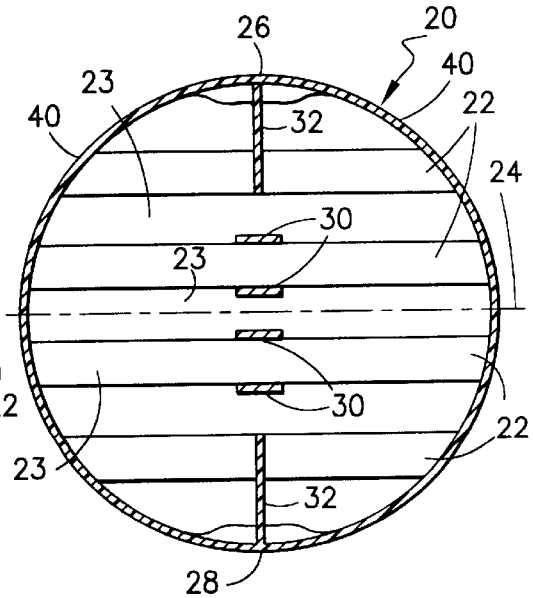
FIG. 4 PRIOR ART
FIG. 4 is a cross-sectional view of the toy ball, taken along line 4—4 of FIG. 2.

Referring now to the drawing, and especially to FIGS. 1 through 4 thereof, a toy ball 20 known in the prior art has a construction which includes a plurality of ribs 22 extending parallel to one another and parallel to an equator 24, and spaced apart by spaces 23, between opposite poles 26 and 28. Some of the ribs 22 which are more closely adjacent the equator 24 are tied together by transverse straps 30 extending in first lateral directions through the interior of the ball 20, while others of the ribs 22 located more closely adjacent the poles 26 and 28 are tied together by fins 32 extending through the interior of the ball 20 in second lateral directions normal to the first lateral directions of the straps 30. The ribs 22 and spaces 23 extend along opposite hemispheres 34 and 36 and the hemispheres 34 and 36 are joined along meridian portions 40 extending between the poles 26 and 28. The ribs 22 of one of the hemispheres 34 and 36 are staggered in directions between the poles 26 and 28 relative to the ribs 22 of the other of the hemispheres 34 and 36 so that each rib 22 of a hemisphere 34 or 36 is opposite a space 23 in the opposite hemisphere 36 or 34, respectively. The construction enables the ball 20 to be manufactured in one piece by injection molding.

Turning now to FIGS. 5 through 12, a toy game implement constructed in accordance with the present invention is illustrated in the form of a toy baseball bat 50. Bat 50 has an elongate body 52 extending longitudinally along a longitudinal axis A between a first end 54 and an opposite second end 56 and includes a striking portion 60 and a gripping portion 62. The striking portion 60 has a longitudinal length L and an overall outer contour configuration C which includes longitudinal profile components 64 lying in longitudinal planes containing axis A, and lateral profile components 66 lying in lateral planes perpendicular to axis A. The longitudinal profile components 64 follow the longitudinal contour configuration of the striking portion of a typical baseball bat, and the lateral profile components 66 are circular and have radii which vary along the longitudinal direction so that together the longitudinal and lateral profile components 64 and 66 provide the overall outer contour configuration C with a shape which emulates the striking portion of a baseball bat.

A web 70 extends longitudinally along the striking portion 60, from the first end 54 toward the second end 56 of the body 52. Web 70 includes laterally opposite edges 72 and opposite faces 74 extending between the opposite edges 72 along the length of the web 70. Each edge 72 follows a web-edge profile 76, the shape of which web-edge profile 76 follows along a corresponding longitudinal profile component 64 of the striking portion 60. In the preferred construction, web 70 lies in a plane 78 (see FIG. 12) extending longitudinally and laterally and containing axis A so as to be located generally centrally of the striking portion 60, and is a solid and continuous blade-like wall which serves as a relatively rigid reinforcing backbone all along the striking portion 60.

A plurality of ribs 80 are coaxial with axis A and are spaced from one another longitudinally along the striking portion 60, the ribs 80 being spaced apart a distance D to establish spaces 82 between adjacent ribs 80. The ribs 80 have an overall semi-annular configuration, intersect the web 70 along the edges 72 of the web 70 and are unitary with the web 70 where the ribs 80 intersect the web 70. Each rib 80 is placed at an individual longitudinal location along the web 70 and follows a rib profile 86 corresponding to the lateral profile component 66 of the overall outer contour configuration C of the striking portion 60 at that location. To that end, the ribs 80 are generally arcuate in planes perpendicular to axis A and include radii which vary along the length of the striking portion 60 so as to correspond to the overall outer contour configuration C of the striking portion 60. The ribs 80 and spaces 82 are grouped in laterally opposite first and second sets 90 and 92, respectively, of ribs 80 and spaces 82, and the first set 90 of ribs 80 and spaces 82 are staggered longitudinally with respect to the second set 92 of ribs 80 and spaces 82 such that the ribs 80 of the first set 90 are located laterally opposite the spaces 82 of the second set 92, and the ribs 80 of the second set 92 are located laterally opposite the spaces 82 of the first set 90.

Since the bat 50 is to be used primarily by children, it has been found that for safety reasons the distance D between ribs 80 must be such that a child's finger or fingers cannot become caught between adjacent ribs 80. Accordingly, the distance D is made either so small that a finger cannot enter a space 82, or so large that a finger which does enter a space 82 cannot become caught in the space 82. Accordingly, distance D is made either no less than 0.310 inch or no more than 0.250 inch. In the preferred embodiment, distance D is about 0.340 inch.

The striking portion 60 includes stringers 100 spaced laterally from the faces 74 of the web 70 and extending longitudinally along stringer profiles 102 corresponding to further longitudinal profile components 64 of the overall outer contour configuration C of the striking portion 60. The stringers 100 join the ribs 80 of the first set 90 with the ribs 80 of the second set 92. In the preferred construction, the stringers 100 are unitary with the ribs 80 and extend along a plane 104 (see FIG. 12) extending in longitudinal and lateral directions normal to plane 78 and passing through axis A to bisect the web 70. A cap 110 at the first end 54 is unitary with the web 70 and completes the striking portion 60.

Figure 5:
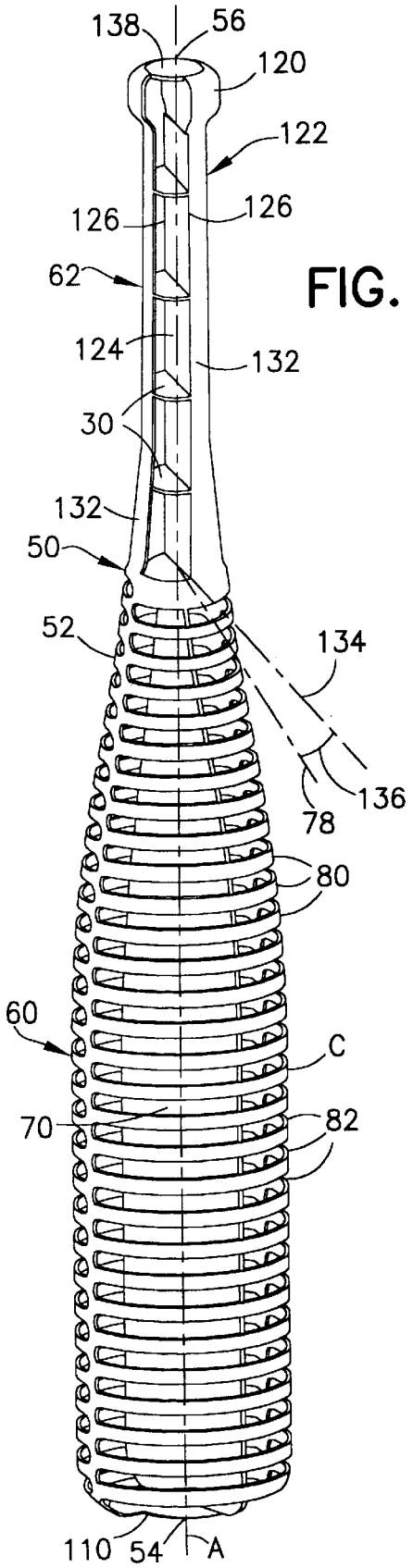
FIG. 5 is a pictorial perspective view of a toy baseball bat constructed in accordance with the present invention.
Figure 8:
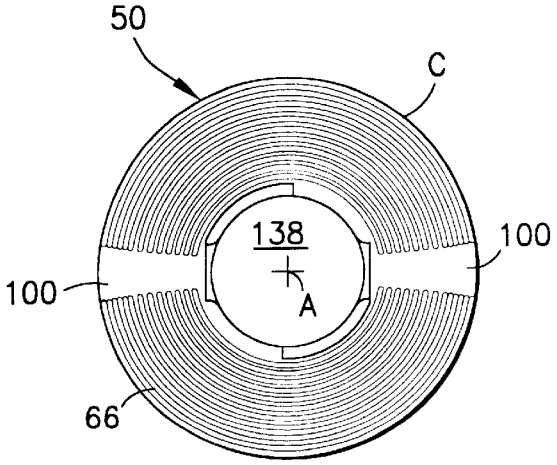
FIG. 8 is a top end view of the toy baseball bat.
Figure 9:
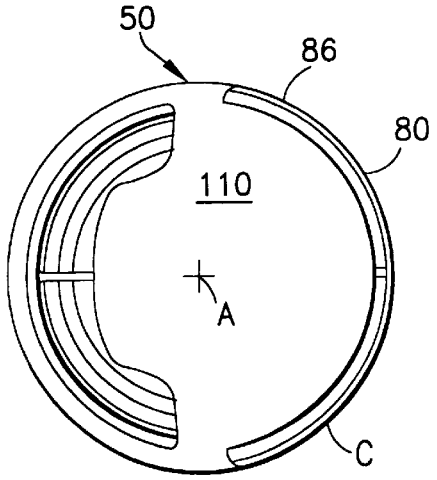
FIG. 9 is a bottom end view of the toy baseball bat.
Figure 6:
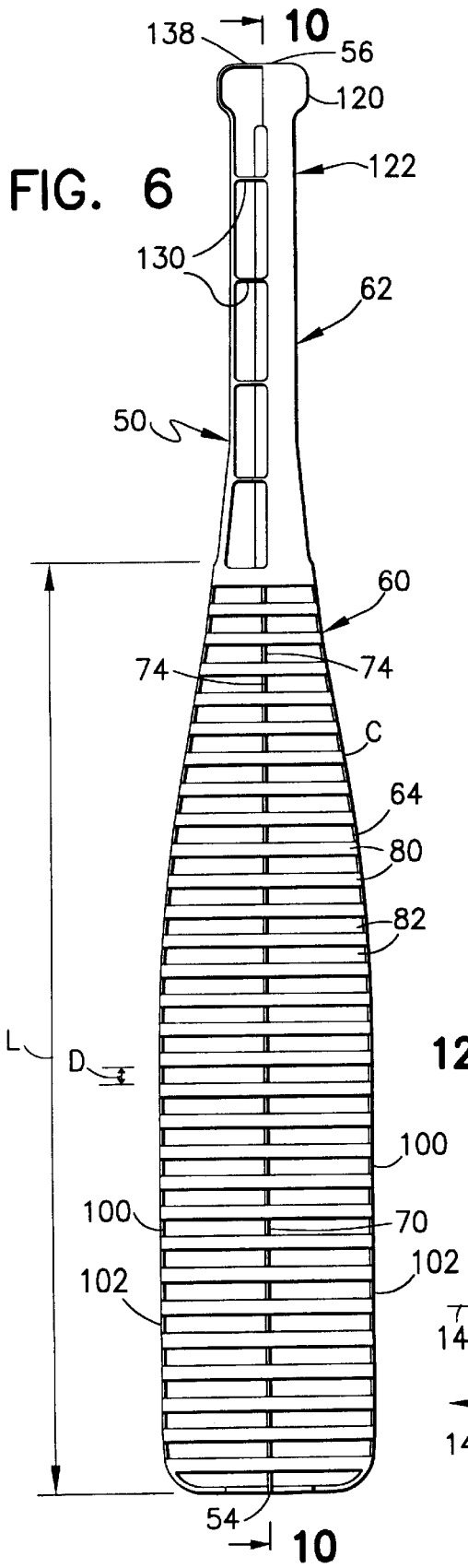
FIG. 6 is a front elevational view of the toy baseball bat.

The gripping portion 62 extends longitudinally between the second end 56 and the striking portion 60 and preferably is unitary with the striking portion 60. A collar 120 is placed at the second end 56 and a hand grip 122 extends longitudinally from the collar 120 to the striking portion 60, as in an actual baseball bat. The gripping portion 62 itself includes a plate 124 extending longitudinally along the gripping portion 62 and laterally between laterally opposite edges 126. Plate 124 preferably is in the form of a solid, essentially flat wall having essentially planar faces 128. Formers 130 extend from the faces 128 generally perpendicular to plate 124 and are spaced from one another longitudinally along the gripping portion 62. The formers 130 support hand grip elements 132 which extend longitudinally along the gripping portion 62 and are curved around the gripping portion 62 to establish the hand grip 122. In the preferred arrangement, the plate 124 is located in a plane 134 which extends in longitudinal and lateral directions and is located generally centrally within the gripping portion 62 and contains axis A; however, plate 124 is offset at a slight angle 136 from the plane 78 in which the web 70 lies, as seen in FIG. 5, so as to facilitate the molding of the gripping portion 62, and especially the hand grip 122 thereof, unitary with the striking portion 60 of the bat 50. Preferably, angle 136 is about 2°. An end wall 138 closes the second end 56 of the body 50.

Figure 7:
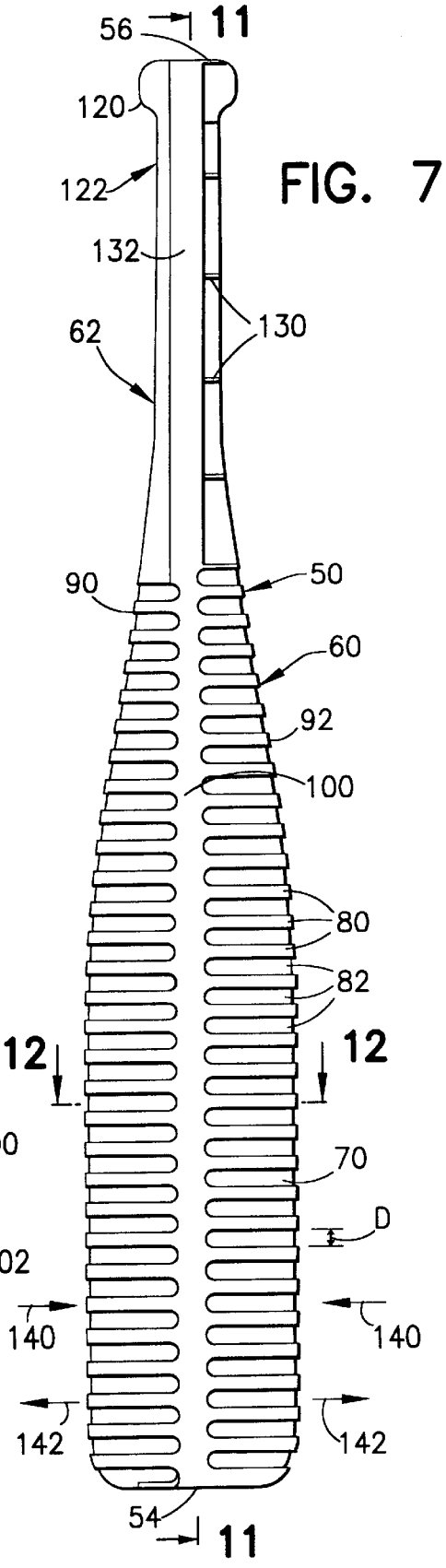
FIG. 7 is a side elevational view of the toy baseball bat.
Figure 10:
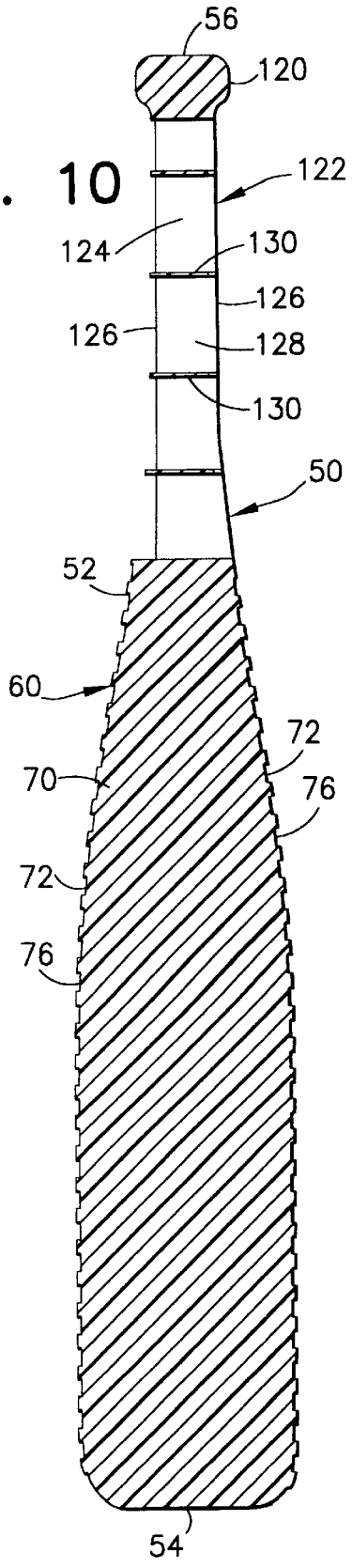
FIG. 10 is a cross-sectional view taken along line 10—10 of FIG. 6.
Figure 11:
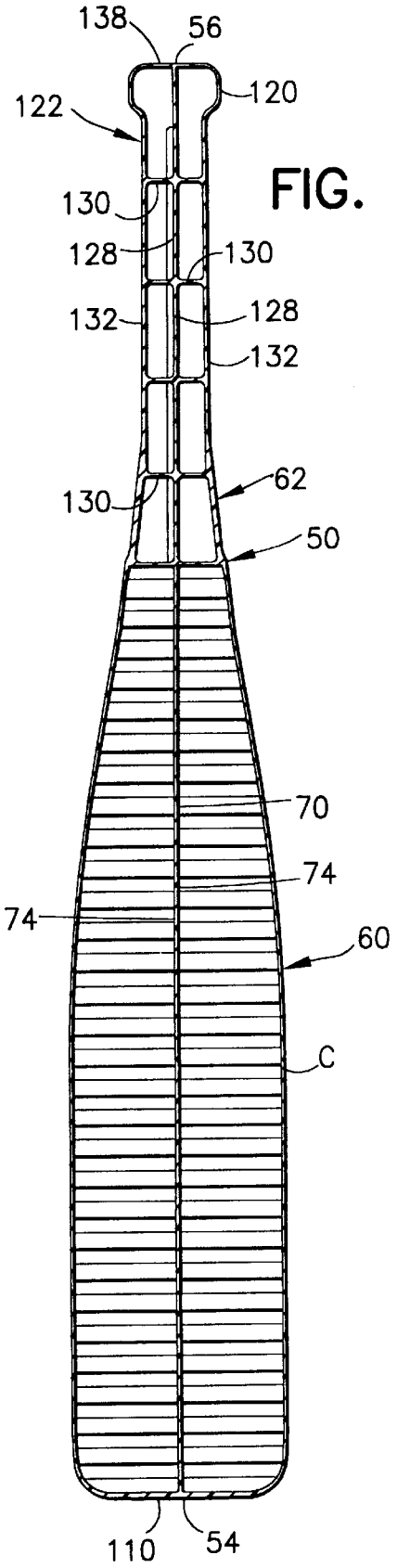
FIG. 11 is a cross-sectional view taken along line 11—11 of FIG. 7.
Figure 12:
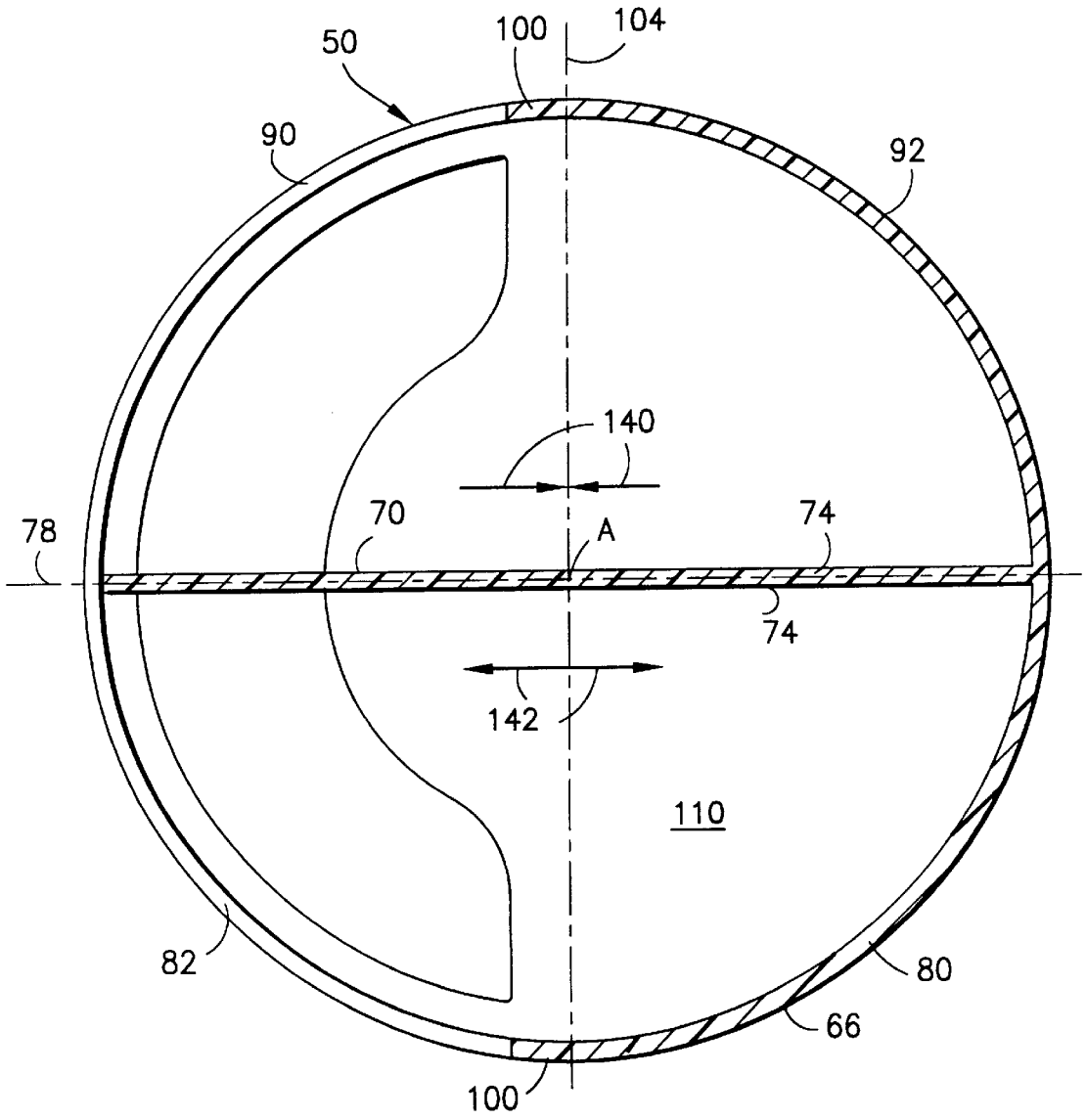
FIG. 12 is an enlarged cross-sectional view taken along line 12—12 of FIG. 7.

The above-described construction is especially well-suited to molding by injection molding, allowing the use of preferred synthetic polymeric materials, such as high-density polyethylene. As best seen in FIGS. 7 and 12, the configuration of bat 50 allows injection molding dies (not shown) to be engaged and parted along directions 140 and 142, respectively, in the manufacture of bat 50. Thus, bat 50 preferably is molded in a single, unitary construction which includes all of the elements of the striking portion 60 and the gripping portion 62 joined together in a one-piece bat 50. The ribbed construction of the striking portion 60, with the reinforcement provided by the web 70 and the stringers 100, enables a desired resiliency for a toy bat with sufficient strength for rugged and reliable performance over a long service life. In addition, the ribbed construction offers a unique appearance which is both aesthetically appealing and highly distinctive. The reinforcement provided to the hand grip elements 132 by the plate 124 and the formers 130 establishes a desired high degree of rigidity as well as comfort in hand grip 122.

Figure 13:
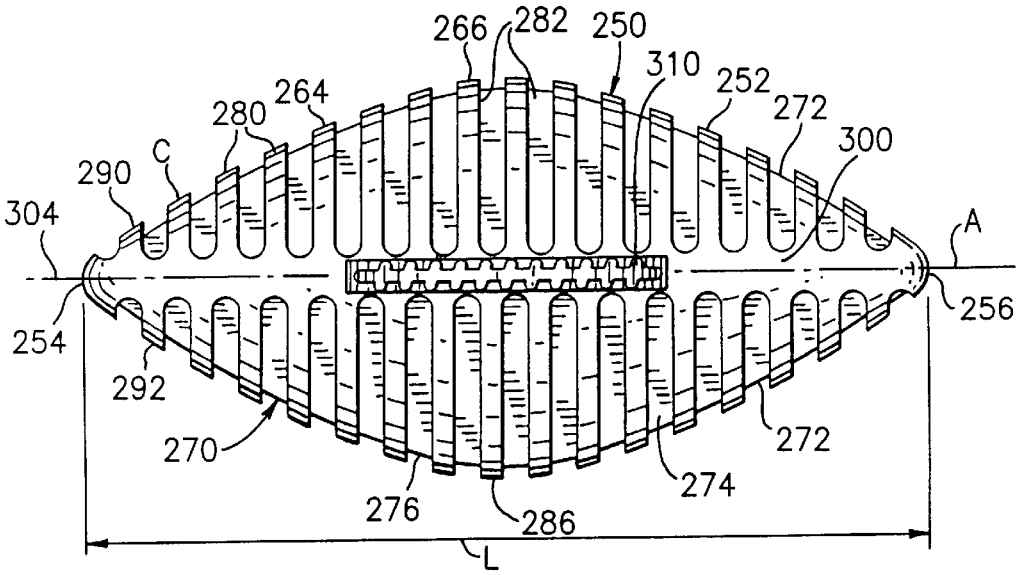
FIG. 13 is a top plan view of a toy ball constructed in accordance with the present invention.
Figure 14:
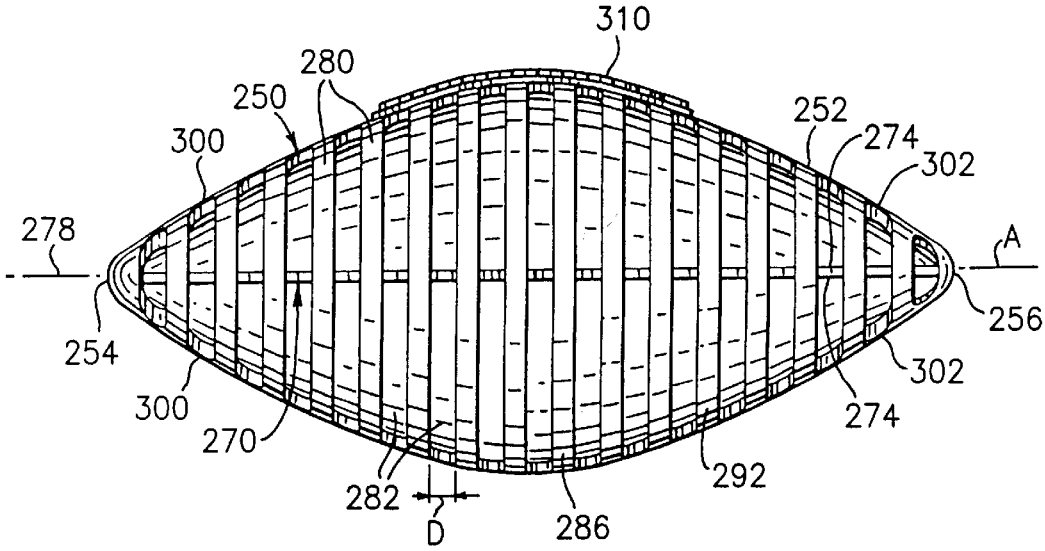
FIG. 14 is a front elevational view of the toy ball.

Referring now to FIGS. 13 and 14, another toy game implement constructed in accordance with the present invention is illustrated as a toy ball in the form of a toy football 250. Toy football 250 has an elongate body 252 extending longitudinally along a longitudinal axis A between a first end 254 and an opposite second end 256. The body 252 has a longitudinal length L and an overall outer contour configuration C which includes longitudinal profile components 264 lying in longitudinal planes containing axis A, and lateral profile components 266 lying in lateral planes perpendicular to axis A. The longitudinal profile components 264 follow the longitudinal contour configuration of the a typical football, and the lateral profile components 266 are circular and have radii which vary along the longitudinal direction so that together the longitudinal and lateral profile components 264 and 266 provide the overall outer contour configuration C with a shape which emulates a football.

A web 270 extends longitudinally along the body 252, from the first end 254 toward the second end 256 of the body 252. Web 270 includes laterally opposite edges 272 and opposite faces 274 extending between the opposite edges 272 along the length of the web 270. Each edge 272 follows a web-edge profile 276, the shape of which web-edge profile 276 follows along a corresponding longitudinal profile component 264 of the body 252. In the preferred construction, web 270 lies in a plane 278 (see FIG. 14) extending longitudinally and laterally and containing axis A so as to be located generally centrally of the body 252, and is a solid and continuous blade-like wall which serves as a relatively rigid reinforcing backbone all along the body 252.

A plurality of ribs 280 are coaxial with axis A and are spaced from one another longitudinally along the body 252, the ribs 280 being spaced apart a distance D to establish spaces 282 between adjacent ribs 280. The ribs 280 have an overall semi-annular configuration, intersect the web 270 along the edges 272 of the web 270 and are unitary with the web 270 where the ribs 280 intersect the web 270. Each rib 280 is placed at an individual longitudinal location along the web 270 and follows a rib profile 286 corresponding to the lateral profile component 266 of the overall outer contour configuration C of the body 252 at that location. To that end, the ribs 280 are generally arcuate in planes perpendicular to axis A and include radii which vary along the length of the body 252 so as to correspond to the overall outer contour configuration C of the body 252. The ribs 280 and spaces 282 are grouped in laterally opposite first and second sets 290 and 292, respectively, of ribs 280 and spaces 282, and the first set 290 of ribs 280 and spaces 282 are staggered longitudinally with respect to the second set 292 of ribs 280 and spaces 282 such that the ribs 280 of the first set 290 are located laterally opposite the spaces 282 of the second set 292, and the ribs 280 of the second set 292 are located laterally opposite the spaces 282 of the first set 290.

Since the football 250 is to be used primarily by children, it has been found that for safety reasons the distance D between ribs 280 must be such that a child's finger or fingers cannot become caught between adjacent ribs 280. Accordingly, the distance D is made either so small that a finger cannot enter a space 282, or so large that a finger which does enter a space 282 cannot become caught in the space 282. Accordingly, distance D is made either no less than 0.310 inch or no more than 0.250 inch. In the preferred embodiment, distance D is about 0.340 inch.

The body 252 includes stringers 300 spaced laterally from the faces 274 of the web 270 and extending longitudinally along stringer profiles 302 corresponding to further longitudinal profile components 264 of the overall outer contour configuration C of the body 252. The stringers 300 join the ribs 280 of the first set 290 with the ribs 280 of the second set 292. In the preferred construction, the stringers 300 are unitary with the ribs 280 and extend along a plane 304 (see FIG. 13) extending in longitudinal and lateral directions normal to plane 278 and passing through axis A to bisect the web 270. A simulated lace 310 is molded unitary with one of the stringers 300 to complete the emulation of a football.

Figure 15:
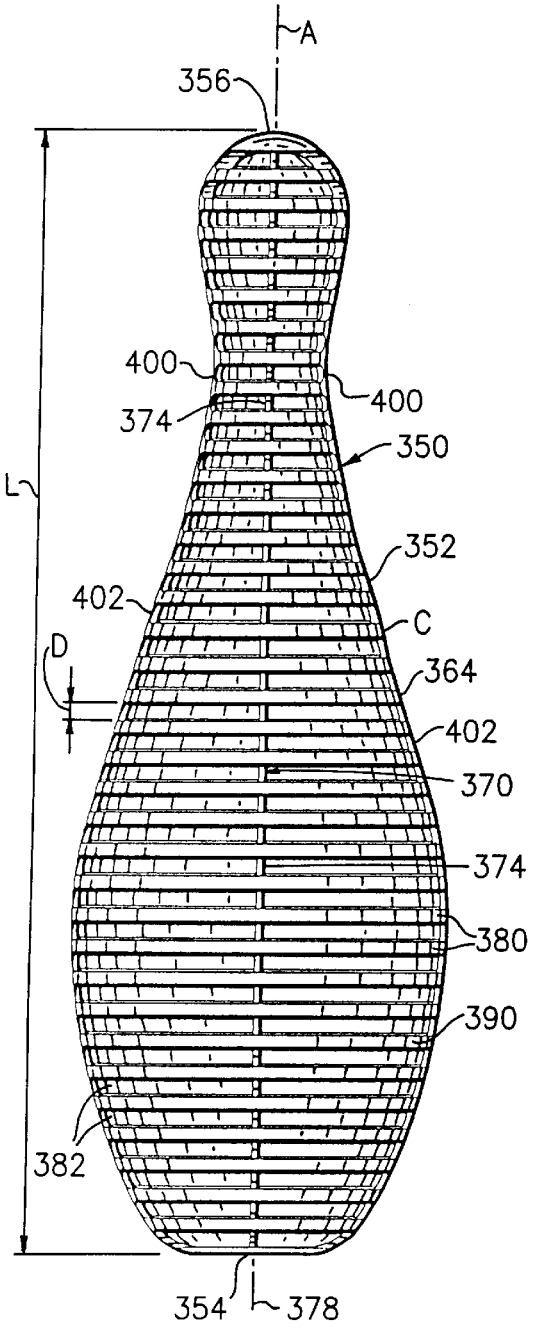
FIG. 15 is a front elevational view of a toy bowling pin constructed in accordance with the present invention.
Figure 16:
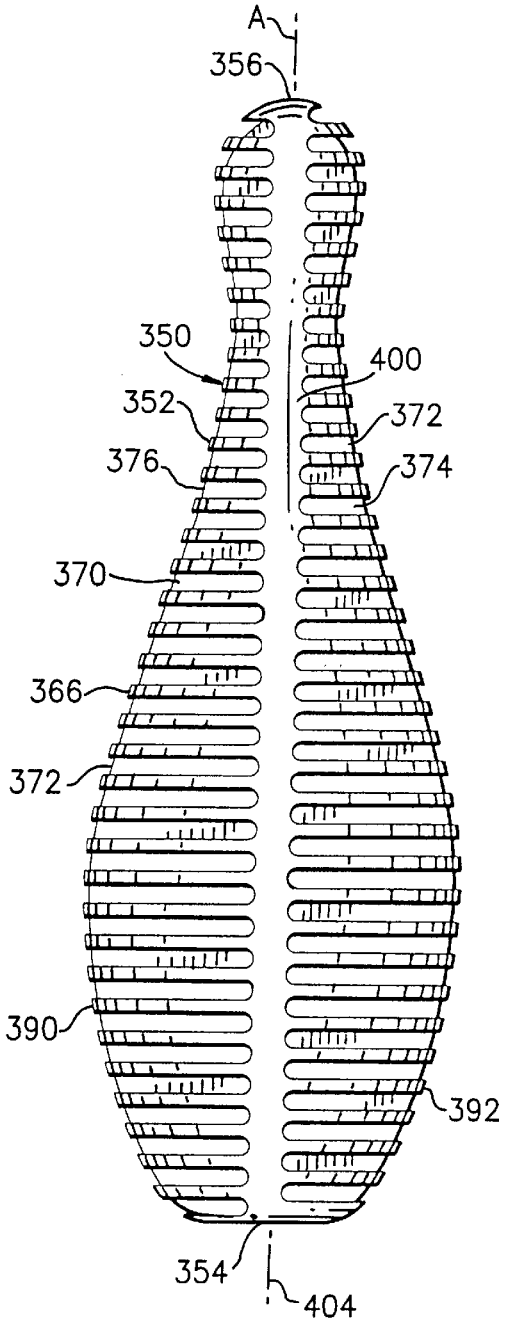
FIG. 16 is a side elevational view of the toy bowling pin.

Turning now to FIGS. 15 and 16, another toy game implement constructed in accordance with the present invention is illustrated in the form of a toy bowling pin 350. Toy bowling pin 350 has an elongate body 352 extending longitudinally along a longitudinal axis A between a first end 354 and an opposite second end 356. The body 352 has a longitudinal length L and an overall outer contour configuration C which includes longitudinal profile components 364 lying in longitudinal planes containing axis A, and lateral profile components 366 lying in lateral planes perpendicular to axis A. The longitudinal profile components 364 follow the longitudinal contour configuration of the a typical bowling pin, and the lateral profile components 366 are circular and have radii which vary along the longitudinal direction so that together the longitudinal and lateral profile components 364 and 366 provide the overall outer contour configuration C with a shape which emulates a bowling pin.

A web 370 extends longitudinally along the body 352, from the first end 354 toward the second end 356 of the body 352. Web 370 includes laterally opposite edges 372 and opposite faces 374 extending between the opposite edges 372 along the length of the web 370. Each edge 372 follows a web-edge profile 376, the shape of which web-edge profile 376 follows along a corresponding longitudinal profile component 364 of the body 352. In the preferred construction, web 370 lies in a plane 378 (see FIG. 15) extending longitudinally and laterally and containing axis A so as to be located generally centrally of the body 352, and is a solid and continuous blade-like wall which serves as a relatively rigid reinforcing backbone all along the body 352.

A plurality of ribs 380 are coaxial with axis A and are spaced from one another longitudinally along the body 352, the ribs 380 being spaced apart a distance D to establish spaces 382 between adjacent ribs 380. The ribs 380 have an overall semi-annular configuration, intersect the web 370 along the edges 372 of the web 370 and are unitary with the web 370 where the ribs 380 intersect the web 370. Each rib 380 is placed at an individual longitudinal location along the web 370 and follows a rib profile 386 corresponding to the lateral profile component 366 of the overall outer contour configuration C of the body 352 at that location. To that end, the ribs 380 are generally arcuate in planes perpendicular to axis A and include radii which vary along the length of the body 352 so as to correspond to the overall outer contour configuration C of the body 352. The ribs 380 and spaces 382 are grouped in laterally opposite first and second sets 390 and 392, respectively, of ribs 380 and spaces 382, and the first set 390 of ribs 380 and spaces 382 are staggered longitudinally with respect to the second set 392 of ribs 380 and spaces 382 such that the ribs 380 of the first set 390 are located laterally opposite the spaces 382 of the second set 392, and the ribs 380 of the second set 392 are located laterally opposite the spaces 382 of the first set 390.

Since the bowling pin 350 is to be used primarily by children, it has been found that for safety reasons the distance D between ribs 380 must be such that a child's finger or fingers cannot become caught between adjacent ribs 380. Accordingly, the distance D is made either so small that a finger cannot enter a space 382, or so large that a finger which does enter a space 382 cannot become caught in the space 382. Accordingly, distance D is made either no less than 0.310 inch or no more than 0.250 inch. In the preferred embodiment, distance D is about 0.340 inch.

The body 352 includes stringers 400 spaced laterally from the faces 374 of the web 370 and extending longitudinally along stringer profiles 402 corresponding to further longitudinal profile components 364 of the overall outer contour configuration C of the body 352. The stringers 400 join the ribs 380 of the first set 390 with the ribs 380 of the second set 392. In the preferred construction, the stringers

400 are unitary with the ribs 380 and extend along a plane 404 (see FIG. 16) extending in longitudinal and lateral directions normal to plane 378 and passing through axis A to bisect the web 370.

It will be seen that the construction of bat 50, football 250 and bowling pin 350 attains the objects and advantages outlined above, namely: Enables the manufacture of toy game implements, such as toy baseball bats, balls and bowling pins, using injection molding techniques and materials heretofore not available for such toys; provides toy game implements, such as bats, clubs, sticks, balls, bowling pins and the like, of increased strength and reliability; produces toy game implements which exhibit an effective combination of unique and highly distinctive form as well as an aesthetically attractive appearance; attains a desired resilience coupled with reinforced strength in toy game implements of economical construction; allows economical manufacture of toy game implements of better controlled dimensions in larger quantities of consistently higher quality and in a wider variety of desirable shapes, sizes and colors; enables the manufacture of rugged toy game implements providing exemplary performance over a relatively long service life.

It is to be understood that the above-described detailed description of a preferred embodiments of the invention is provided by way of example only. Various details of design and construction may be modified without departing from the principles and scope of the invention, as set forth in the appended claims.

The embodiments of the invention in which an exclusive property or privilege is claimed are defined as follows:

1. A toy game implement particularly well-suited for manufacture by injection molding of a synthetic polymeric material, the implement comprising:

an elongate body extending longitudinally between opposite first and second ends and having a longitudinal length;

an outer contour configuration including longitudinal profile components and lateral profile components;

a web extending longitudinally between the first end and the second end, the web including laterally opposite edges and opposite faces extending between the laterally opposite edges, each edge following a web-edge profile corresponding to a longitudinal profile component of the outer contour configuration of the body;

a plurality of ribs spaced from one another longitudinally along the body to establish spaces between adjacent ribs, the ribs intersecting the web along the edges of the web, each rib being placed at an individual longitudinal location along the web and following a rib profile corresponding to a lateral profile component of the outer contour configuration of the body, the ribs and spaces being grouped in laterally opposite first and second sets of ribs and spaces, the first set of ribs and spaces being staggered longitudinally with respect to the second set of ribs and spaces such that the ribs of the first set are located laterally opposite the spaces of the second set and the ribs of the second set are located laterally opposite the spaces of the first set; and stringers spaced laterally from the opposite faces of the web and joining the ribs of the first set to the ribs of the second set, the stringers extending along stringer profiles corresponding to further longitudinal profile components of the outer contour configuration of the body.

2. The invention of claim 1 wherein the web is essentially solid between the laterally opposite edges of the web.

3. The invention of claim 1 wherein the web lies generally within a first plane extending in longitudinal and lateral directions.

4. The invention of claim 3 wherein the web is essentially solid between the laterally opposite edges of the web.

5. The invention of claim 3 wherein the stringers lie in a second plane extending essentially in longitudinal and lateral directions, essentially normal to the first plane.

6. The invention of claim 5 wherein the second plane essentially bisects the web.

7. The invention of claim 6 wherein the ribs are arcuate in further planes extending essentially normal to the first and second planes, each rib having a radius lying in a corresponding one of the further planes.

8. The invention of claim 7 wherein the space between the ribs is no more than 0.250 inch.

9. The invention of claim 7 wherein the space between the ribs is no less than 0.310 inch.

10. The invention of claim 7 wherein the space between the ribs is about 0.340 inch.

11. The invention of claim 7 wherein the game implement is a toy ball and the radii of the ribs are varied along the longitudinal length of the body to establish a toy ball configuration.

12. The invention of claim 11 wherein the toy ball is a toy football and the radii of the ribs are varied along the longitudinal length of the body to establish a toy football configuration.

13. The invention of claim 7 wherein the game implement is a toy bowling pin and the radii of the ribs are varied along the longitudinal length of the body to establish a toy bowling pin configuration.

14. The invention of claim 1 wherein the space between the ribs is no more than 0.250 inch.

15. The invention of claim 1 wherein the space between the ribs is no less than 0.310 inch.

16. The invention of claim 1 wherein the space between the ribs is about 0.340 inch.

* * * * *